US009013358B2

(12) United States Patent
Hsu

(10) Patent No.: US 9,013,358 B2
(45) Date of Patent: Apr. 21, 2015

(54) ANTENNA ASSEMBLY AND WIRELESS COMMUNICATION DEVICE PROVIDED WITH THE SAME

(71) Applicant: Wistron NeWeb Corp., Hsinchu County (TW)

(72) Inventor: Mao-Kai Hsu, Hsinchu County (TW)

(73) Assignee: Wistron NeWeb Corp., Hsinchu County (TW)

( * ) Notice: Subject to any disclaimer, the term of this patent is extended or adjusted under 35 U.S.C. 154(b) by 265 days.

(21) Appl. No.: 13/832,640

(22) Filed: Mar. 15, 2013

(65) Prior Publication Data

US 2014/0118215 A1 May 1, 2014

(30) Foreign Application Priority Data

Oct. 29, 2012 (TW) ..... 101139932 A

(51) Int. Cl.

| | |
|---|---|
| ***H01Q 1/24*** | (2006.01) |
| ***H01Q 1/38*** | (2006.01) |
| ***H01Q 21/28*** | (2006.01) |
| ***H01Q 1/48*** | (2006.01) |
| ***H01Q 1/52*** | (2006.01) |
| ***H01Q 9/42*** | (2006.01) |

(52) U.S. Cl.

CPC ..... *H01Q 21/28* (2013.01); *H01Q 1/48* (2013.01); *H01Q 1/521* (2013.01); *H01Q 9/42* (2013.01)

(58) Field of Classification Search

CPC ..... H01Q 1/521; H01Q 1/243; H01Q 1/2266; H01Q 21/28

USPC ..... 343/702, 700 MS, 841

See application file for complete search history.

(56) References Cited

U.S. PATENT DOCUMENTS

| | | | | |
|---|---|---|---|---|
| 6,624,789 | B1 * | 9/2003 | Kangasvieri et al. | 343/702 |
| 8,552,913 | B2 * | 10/2013 | Ayatollahi et al. | 343/702 |
| 8,816,921 | B2 * | 8/2014 | Ayatollahi | 343/745 |
| 8,922,448 | B2 * | 12/2014 | Wong et al. | 343/841 |
| 2012/0127038 | A1 * | 5/2012 | Kim et al. | 343/700 MS |
| 2013/0120201 | A1 * | 5/2013 | Park et al. | 343/749 |

* cited by examiner

*Primary Examiner* — Hoang V Nguyen
(74) *Attorney, Agent, or Firm* — LeClairRyan

(57) ABSTRACT

An antenna assembly includes a pair of antennas and an interconnecting portion. Each antenna includes a ground portion, a feed-in portion spaced apart from the ground portion and having a feed-in end that is configured to be fed with a RF signal, a short-circuit portion electrically connected to the ground portion and the feed-in portion, and a radiating portion electrically connected to the feed-in portion and spaced apart from the ground portion. The interconnecting portion is electrically connected between the short-circuit portions and between the ground portions of the pair of antennas, and is formed with a U-shaped main groove that has a pair of opposite ends adjacent to the pair of antennas, respectively.

20 Claims, 6 Drawing Sheets

ANTENNA ASSEMBLY AND WIRELESS COMMUNICATION DEVICE PROVIDED WITH THE SAME

CROSS-REFERENCE TO RELATED APPLICATION

This application claims priority of Taiwanese Application No. 101139932, filed on Oct. 29, 2012.

BACKGROUND OF THE INVENTION

1. Field of the Invention

The present invention relates to an antenna assembly, more particularly to an antenna assembly having relatively high isolation. The present invention further relates to a wireless communication device provided with the antenna assembly having relatively high isolation.

2. Description of the Related Art

A conventional portable electronic device is typically provided with a plurality of antennas to receive and transmit wireless signals of different wireless communication protocols. For instance, the conventional portable electronic device may be provided with an inverted-F antenna for Wireless Local Area Network (WLAN), and another inverted-F antenna to support Bluetooth transmission.

As the portable electronic devices are miniaturized, a distance between antennas within the same device is relatively smaller. When two antennas are close to each other and operate at the same resonant frequency band, the antennas will interfere with each other, thereby resulting in a low isolation therebetween.

SUMMARY OF THE INVENTION

Therefore, an object of the present invention is to provide an antenna assembly having relatively high isolation.

Accordingly, an antenna assembly of the present invention comprises a first antenna, a second antenna and an interconnecting portion.

The first antenna includes a first ground portion, a first feed-in portion, a first short-circuit portion, and a first radiating portion. The first feed-in portion is spaced apart from the first ground portion and has a first feed-in end that is configured to be fed with a first radio frequency (RF) signal. The first short-circuit portion is electrically connected to the first ground portion and the first feed-in portion. The first radiating portion is electrically connected to the first feed-in portion and is spaced apart from the first ground portion.

The second antenna includes a second ground portion, a second feed-in portion, a second short-circuit portion, and a second radiating portion. The second feed-in portion is spaced apart from the second ground portion and has a second feed-in end that is configured to be fed with a second RF signal. The second short-circuit portion is electrically connected to the second ground portion and the second feed-in portion. The second radiating portion is electrically connected to the second feed-in portion and is spaced apart from the second ground portion.

The interconnecting portion is electrically connected between the first and second short-circuit portions and between the first and second ground portions. The interconnecting portion is formed with a generally U-shaped main groove that has a pair of opposite ends adjacent to the first and second antennas, respectively.

BRIEF DESCRIPTION OF THE DRAWINGS

Other features and advantages of the present invention will become apparent in the following detailed description of the embodiments with reference to the accompanying drawings, of which.

DETAILED DESCRIPTION OF THE EMBODIMENTS

Figure 1:
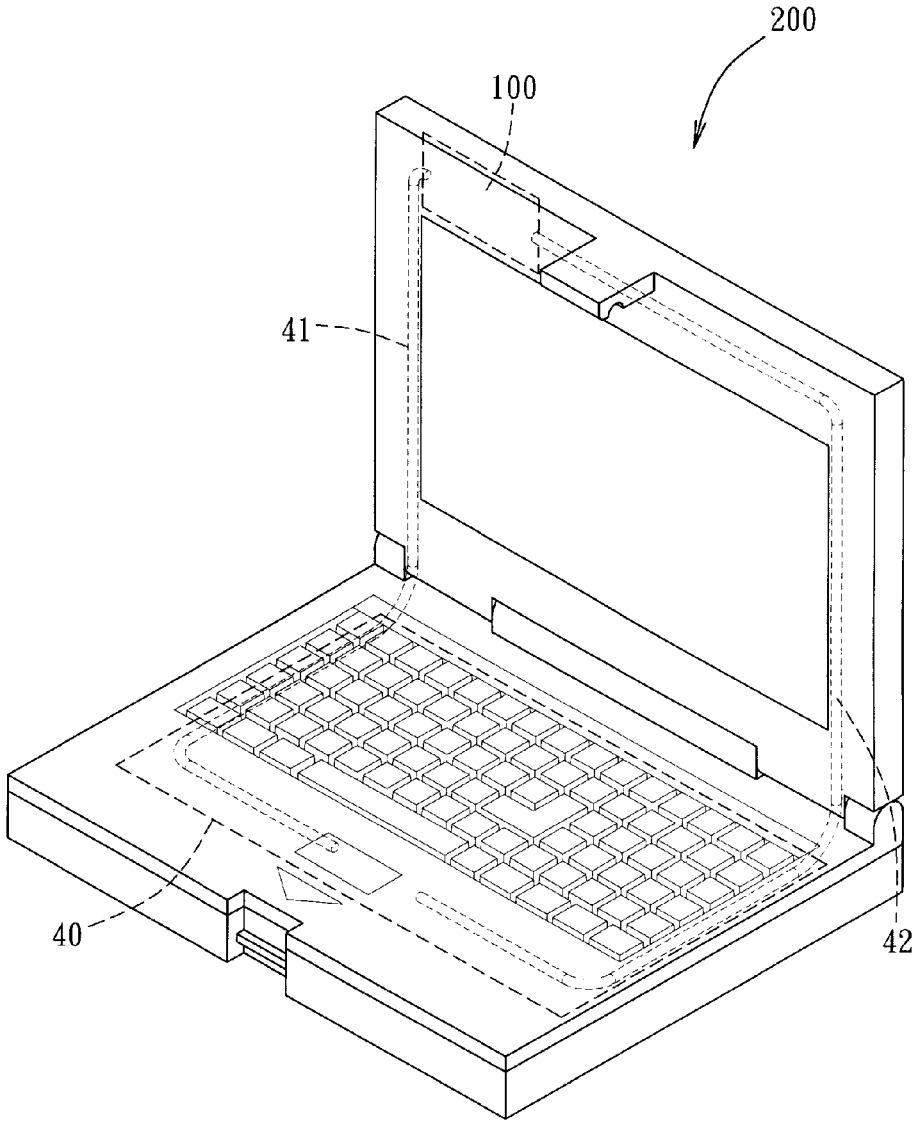
FIG. 1 is a perspective view of a wireless communication device according to an embodiment of the present invention.

Before the present invention is described in greater detail, it should be noted that like elements are denoted by the same reference numerals throughout the disclosure.

Referring to FIG. 1, a wireless communication device 200 according to an embodiment of the present invention is shown to include a communication module 40, a first transmission element 41, a second transmission element 42 and an antenna assembly 100. The wireless communication device 200 may be a mobile communication device, such as a smart phone, a tablet computer, a laptop, a portable navigation device, etc.

The communication module 40 is for generating a first radio frequency (RF) signal and a second RF signal. The first transmission element 41 is electrically connected between the communication module 40 and the antenna assembly 100 for delivering the first RF signal from the communication module 40 to the antenna assembly 100. The second transmission element 42 is electrically connected between the communication module 40 and the antenna assembly 100 for delivering the second RF signal from the communication module 40 to the antenna assembly 100. The first and second transmission elements 41, 42 are coaxial wires in this embodiment.

The antenna assembly 100 shown in FIG. 1 is disposed at a top portion of a display of the wireless communication device 200 (e.g., a laptop in this embodiment). However, it is evidence to those skilled in the art that the position of the antenna assembly 100 shown in FIG. 1 is merely for illustrative purpose and the present invention is not limited to the disclosure of this embodiment. The antenna assembly 100 may be disposed at a bottom portion of the display, a side of a keyboard, a hinge part of the display, or any other position in actual implementation.

Figure 2:
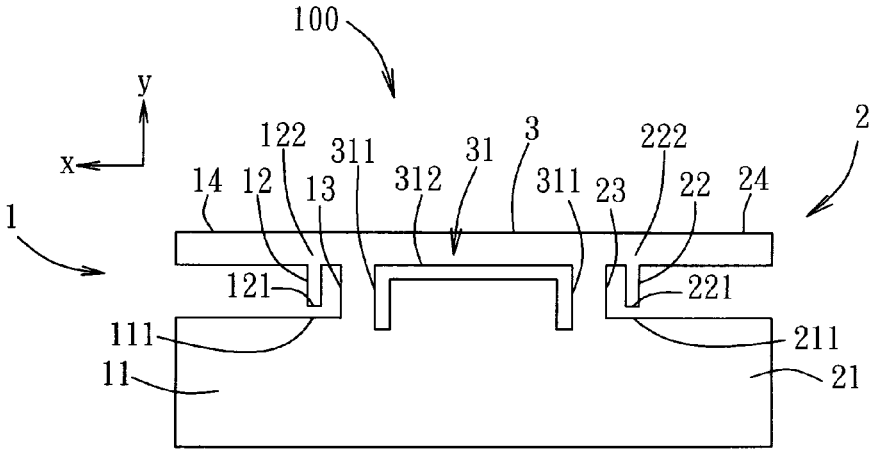
FIG. 2 is a schematic view of a first embodiment of the antenna assembly according to the present invention.

Referring to FIG. 2, a schematic view of a first embodiment of the antenna assembly 100 according to the present invention is shown. The antenna assembly 100 includes a first antenna 1, a second antenna 2 and an interconnecting portion 3. The first and second antennas 1, 2 are inverted-F antennas, and are spaced apart from each other in an x direction.

The first antenna 1 includes a first ground portion 11, a first feed-in portion 12, a first short-circuit portion 13 and a first radiating portion 14. The first ground portion 11 is a substantially rectangular conductor, and has a first ground end 111. The first feed-in portion 12 extends in a y direction that is perpendicular to the x direction, and is spaced apart from the first ground portion 11 in the y direction. The first feed-in portion 12 has a first feed-in end 121 close to the first ground end 111 of the first ground portion 11 and configured to be fed with the first RF signal, and a first opposite end 122 opposite to the first feed-in end 121 and away from the first ground portion 11. The first feed-in end 121 and the first ground end 111 are electrically connected to the first transmission element 41 (see FIG. 1) for receiving the first RF signal and a ground signal, respectively. The first short-circuit portion 13 is generally L-shaped and has two ends, one of which is electrically connected to the first opposite end 122 of the first feed-in portion 12, and the other one of which is electrically connected to the first ground portion 11. The first radiating portion 14 extends in the x direction, is electrically connected to the first opposite end 122 of the first feed-in portion 12, and is spaced apart from the first ground portion 11 in the y direction.

The second antenna 2 includes a second ground portion 21, a second feed-in portion 22, a second short-circuit portion 23 and a second radiating portion 24. The second ground portion 21 is a substantially rectangular conductor, and has a second ground end 211. The second feed-in portion 22 extends in the y direction, and is spaced apart from the second ground portion 21 in the y direction. The second feed-in portion 22 has a second feed-in end 221 close to the second ground end 211 of the second ground portion 21 and configured to be fed with the second RF signal, and a second opposite end 222 opposite to the second feed-in end 221 and away from the second ground portion 21. The second feed-in end 221 and the second ground end 211 are electrically connected to the second transmission element 42 (see FIG. 1) for receiving the second RF signal and the ground signal, respectively. The second short-circuit portion 23 is generally L-shaped and has two ends, one of which is electrically connected to the second opposite end 222 of the second feed-in portion 22, and the other one of which is electrically connected to the second ground portion 21. The second radiating portion 24 extends in the x direction, is electrically connected to the second opposite end 222 of the second feed-in portion 22, and is spaced apart from the second ground portion 21 in the y direction. The first and second radiating portions 14, 24 resonate in a first frequency band. In this embodiment, the first frequency band ranges between 2.4 to 2.5 GHz.

The interconnecting portion 3 is disposed between the first antenna 1 and the second antenna 2, and is electrically connected between the first and second short-circuit portions 13, 23 and between the first and second ground portions 11, 12. The interconnecting portion 3 is formed with a main groove 31 that is in a generally inverted-U shape and that has a pair of opposite ends adjacent to the first and second antennas 1, 2, respectively. More specifically, the main groove 31 includes a pair of first groove segments 311 extending in the y direction, disposed respectively at the opposite ends of the main groove 31, and spaced apart from each other in the x direction. The main groove 31 further includes a second groove segment 312 extending in the x direction and connected between the first groove segments 311. The main groove 31 has a total length (i.e., a summation of lengths of the first and second groove segments 311, 312) substantially equal to ¼ to ¾ of a wavelength corresponding to the first frequency band. By virtue of the interconnecting portion 3 and the main groove 31, isolation between the first and second antennas 1, 2 can be improved.

Figure 3:
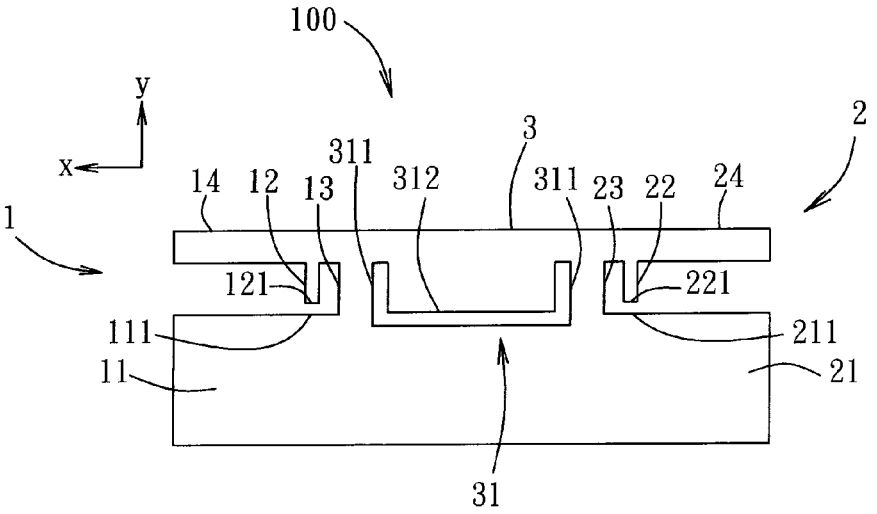
FIG. 3 is a schematic view of a second embodiment of the antenna assembly according to the present invention.

Referring to FIG. 3, a schematic view of a second embodiment of the antenna assembly 100 according to the present invention is shown. The second embodiment of the present invention is similar to the first embodiment. In this embodiment, the main groove 31 of the interconnecting portion 3 of the antenna assembly 100 is generally U-shaped, that is to say, the main groove 31 of the second embodiment is inverse to that of the first embodiment in the y direction.

Figure 4:
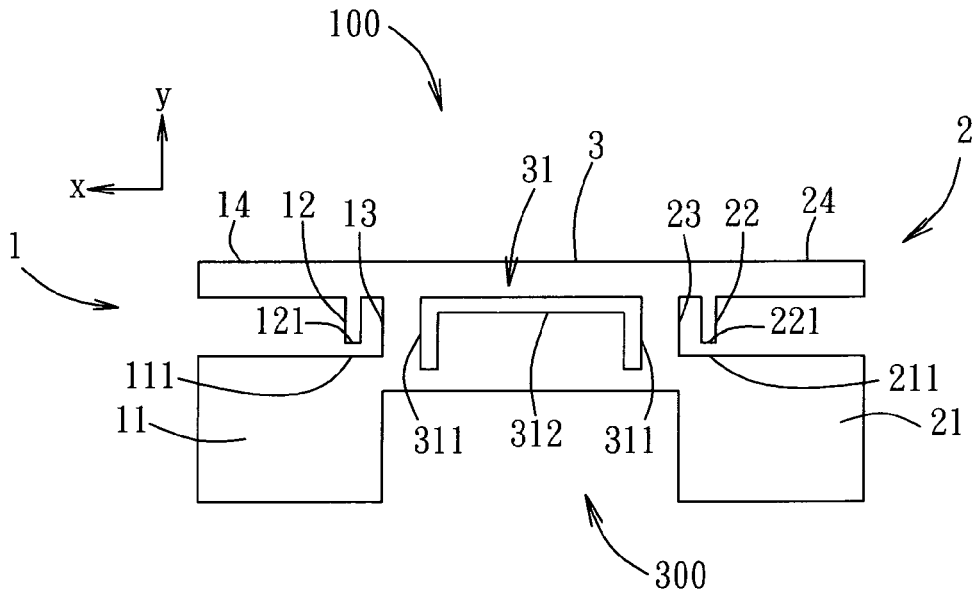
FIG. 4 is a schematic view of a third embodiment of the antenna assembly according to the present invention.

Referring to FIG. 4, a schematic view of a third embodiment of the antenna assembly 100 according to the present invention is shown. The third embodiment of the present invention is similar to the first embodiment. In the third embodiment, the interconnecting portion 3 of the antenna assembly 100 has an area smaller than an area of the interconnecting portion 3 of the first embodiment. The interconnecting portion 3 in this embodiment is depressed in the y direction and cooperates with the first and second ground portions 11, 21 to define a notch 300. The notch 300 is capable of accommodating other electronic components of the wireless communication device 200 (see FIG. 1) when the antenna assembly 100 is disposed in the wireless communication device 200.

Figure 5:
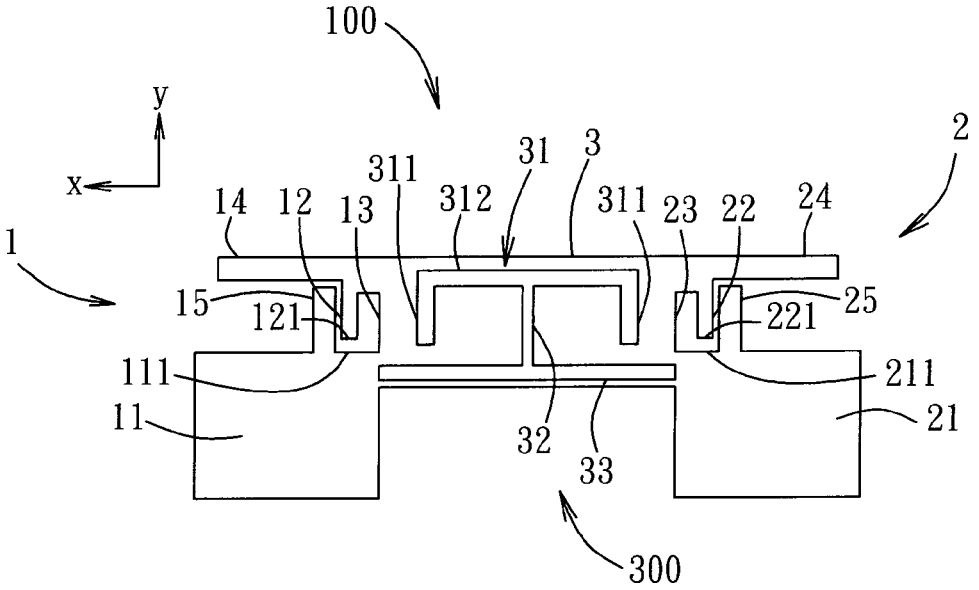
FIG. 5 is a schematic view of a fourth embodiment of the antenna assembly according to the present invention.

Referring to FIG. 5, a schematic view of a fourth embodiment of the antenna assembly 100 according to the present invention is shown. The fourth embodiment of the present invention is similar to the third embodiment. In the fourth embodiment, the first antenna 1 of the antenna assembly 100 further includes a first coupling portion 15. The first coupling portion 15 extends from the first ground portion 11 along the first feed-in portion 12 in the y direction, and is spaced apart from and couples with the first feed-in portion 12 so as to resonate with the first feed-in portion 12 in a second frequency band. In this embodiment, the first coupling portion 15 is disposed at one side of the first feed-in portion 12 away from the interconnecting portion 3, and is parallel to the first feed-in portion 12. In other embodiments, the first coupling portion 15 may be disposed at the other side of the first feed-in portion 12 adjacent to the interconnecting portion 3.

The second antenna 2 of the antenna assembly 100 of this embodiment further includes a second coupling portion 25. The second coupling portion 25 extends from the second ground portion 21 along the second feed-in portion 22 in the y direction, and is spaced apart from and couples with the second feed-in portion 22 so as to resonate with the second feed-in portion 22 in the second frequency band. In this embodiment, the second coupling portion 25 is disposed at one side of the second feed-in portion 22 away from the interconnecting portion 3, and is parallel to the second feed-in portion 22. In other embodiments, the second coupling portion 25 may be disposed at the other side of the second feed-in portion 22 adjacent to the interconnecting portion 3. In this embodiment, the second frequency band ranges between 5.15 to 5.85 GMHz.

The interconnecting portion 3 is further formed with a connecting groove 32 and a supplementary groove 33. The supplementary groove 33 is in an elongated shape, extends in the x direction, and has a pair of opposite ends adjacent to the first and second antennas 1, 2, respectively. The supplementary groove 33 has a length substantially equal to ¼ to ¾ of the wavelength corresponding to the first frequency band. The connecting groove 32 extends in the y direction, is connected between the supplementary groove 33 and the second groove segment 312 of the main groove 31, and is in spatial communication therewith. In this embodiment, the connecting groove 32 has two distal ends, one of which is connected to a midpoint of the supplementary groove 33, and the other one of which is connected to a midpoint of the second groove segment 312. The supplementary groove 33 is configured to adjust impedance matching of the antenna assembly 100 so as to further improve the isolation between the first and second antennas 1, 2.

Figure 6:
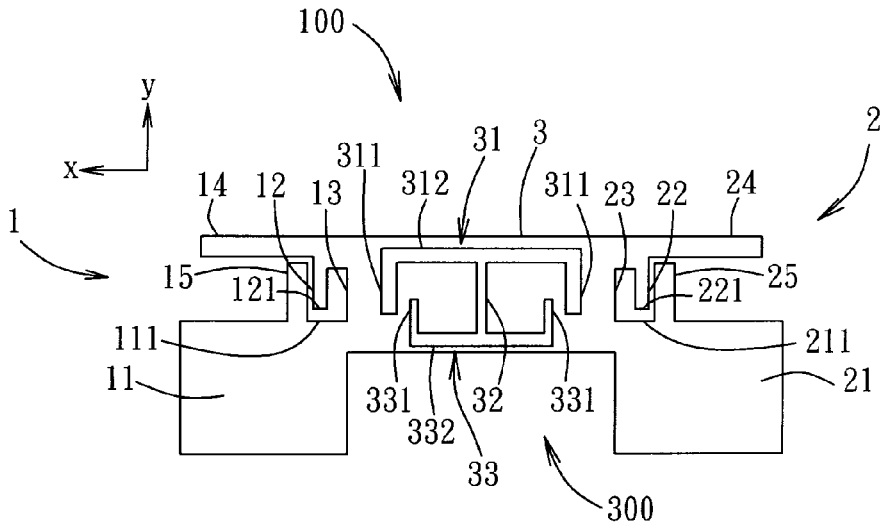
FIG. 6 is a schematic view of a fifth embodiment of the antenna assembly according to the present invention.

Referring to FIG. 6, a schematic view of a fifth embodiment of the antenna assembly 100 according to the present invention is shown. The fifth embodiment of the present invention is similar to the fourth embodiment. In this embodiment, the supplementary groove 33 is generally U-shaped, and has a pair of third groove segments 331 and a fourth groove segment 332. The third groove segments 331 extend in the y direction, are disposed respectively at the opposite ends of the supplementary groove 33, and are spaced apart from each other in the x direction. The fourth groove segment 332 extends in the x direction and is connected between the pair of third groove segments 331. The connecting groove 32 extends in the y direction, is connected between the fourth groove segment 332 of the supplementary groove 33 and the second groove segment 312 of the main groove 31, and is in spatial communication therewith. In this embodiment, the connecting groove 32 has two distal ends, one of which is connected to a midpoint of the fourth groove segment 332, and the other one of which is connected to a midpoint of the second groove segment 312. By changing the elongated supplementary groove 33 of the fourth embodiment to the U-shape supplementary groove 33 of the fifth embodiment, a length of the interconnecting portion 3 in the x direction can be reduced, thereby reducing the size of the antenna assembly 100.

Figure 7:
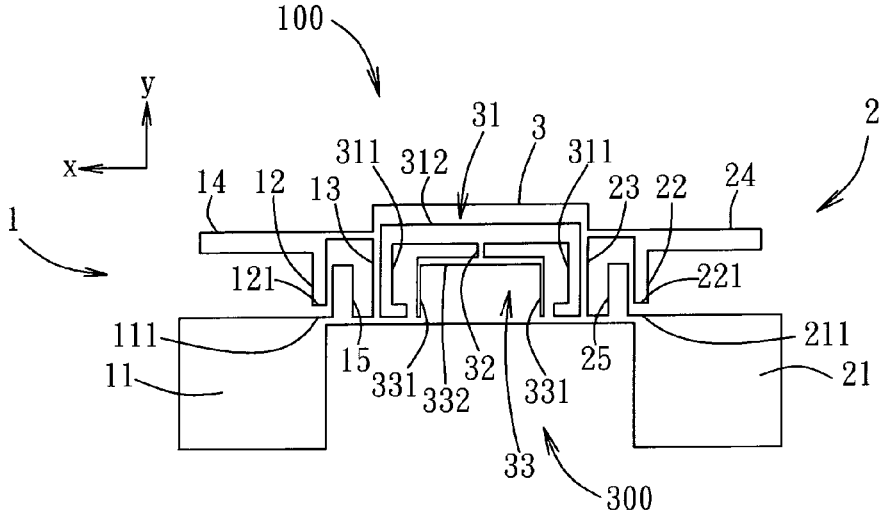
FIG. 7 is a schematic view of a sixth embodiment of the antenna assembly according to the present invention.

Referring to FIG. 7, a schematic view of a sixth embodiment of the antenna assembly 100 according to the present invention is shown. The sixth embodiment of the present invention is similar to the fifth embodiment. In this embodiment, the first coupling portion 15 is disposed between and spaced apart from the first feed-in portion 12 and the interconnecting portion 3. The second coupling portion 25 is configured to be disposed between and spaced apart from the second feed-in portion 22 and the interconnecting portion 3. In addition, each first groove segment 311 of the main groove 31 is in an L-shape. Moreover, the supplementary groove 33 is in an inverted-U shape.

Figure 8:
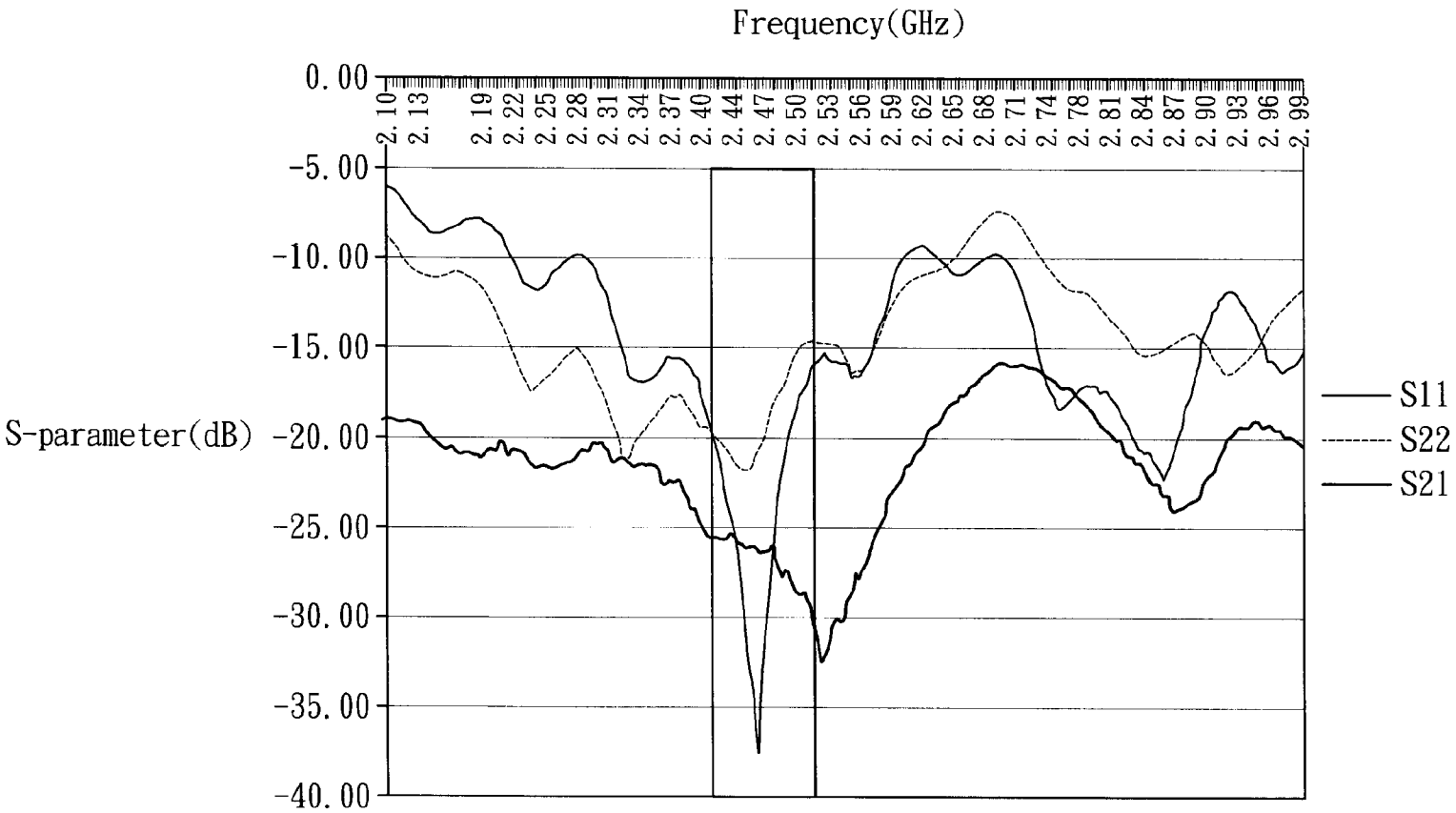
FIG. 8 is a plot showing S-parameters of the antenna assembly of the fifth embodiment according to the present invention.

FIG. 8 is a plot showing S-parameters of the antenna assembly 100 of the fifth embodiment according to the present invention. A first curve (S11) is related to return loss at the first feed-in end 121 of the first antenna 1. A second curve (S22) is related to return loss at the second feed-in end 221 of the second antenna 2. A third curve (S21) represents the isolation between the first feed-in end 121 of the first antenna 1 and the second feed-in end 221 of the second antenna 2. As shown in FIG. 8, within the first frequency band (2.4 to 2.5 GHz), the return loss at the first feed-in end 121 of the first antenna 1 is lower than −10 dB, the return loss at the second feed-in end 221 of the second antenna 2 is lower than −10 dB, and the isolation between the first feed-in end 121 of the first antenna 1 and the second feed-in end 221 of the second antenna 2 is lower than −25 dB.

Figure 9:
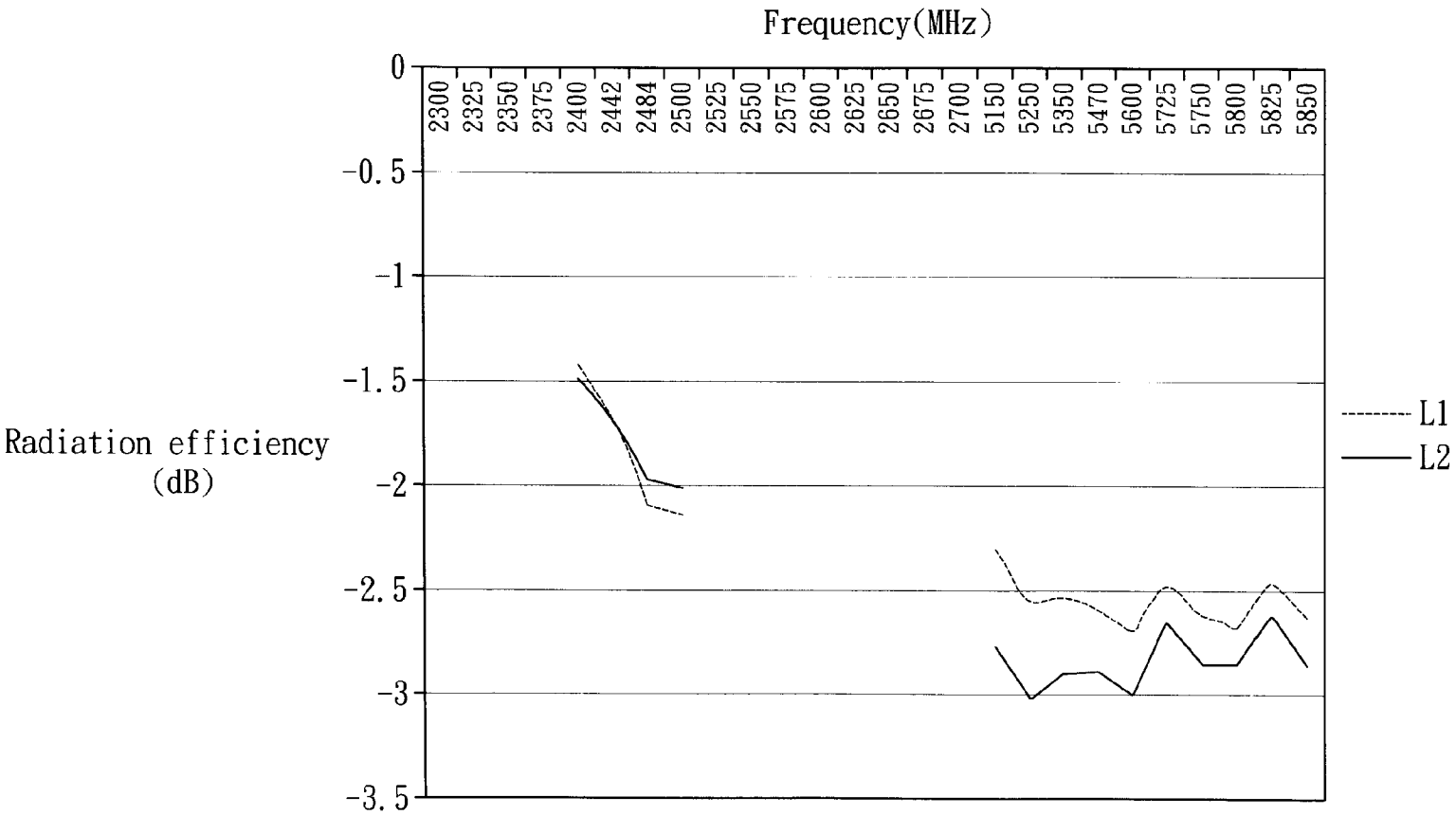
FIG. 9 is a plot showing radiation efficiency of the antenna assembly of the fifth embodiment according to the present invention.

FIG. 9 is a plot showing radiation efficiency of the antenna assembly 100 of the fifth embodiment according to the present invention. A fourth curve (L1) represents radiation efficiency of the first antenna 1, and a fifth curve (L2) represents radiation efficiency of the second antenna 2. Further referring to FIG. 8, it is clear that high isolation between the first and second antennas 1, 2 does not reduce the radiation efficiency. In other words, improvement of the isolation between the first and second antennas 1, 2 will not reduce the radiation efficiency of the first and second antennas 1, 2.

It is noted that, although the first and second antennas 1, 2 of the aforesaid embodiments of the present invention are symmetrical, the first and second antennas 1, 2 may have different sizes and shapes in other embodiments. The first and second radiating portions 14, 24 may be modified as desired. The present invention should not be limited to the disclosure of the aforesaid embodiments.

To conclude, the antenna assembly 100 according to the present invention includes the interconnecting portion 3 formed with the main groove 31, effectively improving the isolation between the first and the second antennas 1, 2. By virtue of the supplementary groove 33, the isolation can be further improved. Moreover, the radiation efficiency of the first and the second antennas 1, 2 can be maintained.

While the present invention has been described in connection with what are considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An antenna assembly, comprising:

a first antenna including a first ground portion, a first feed-in portion being spaced apart from said first ground portion and having a first feed-in end that is configured to be fed with a first radio frequency (RF) signal, a first short-circuit portion electrically connected to said first ground portion and said first feed-in portion, and a first radiating portion electrically connected to said first feed-in portion and spaced apart from said first ground portion;

a second antenna including a second ground portion, a second feed-in portion being spaced apart from said second ground portion and having a second feed-in end that is configured to be fed with a second RF signal, a second short-circuit portion electrically connected to said second ground portion and said second feed-in portion, and a second radiating portion electrically connected to said second feed-in portion and spaced apart from said second ground portion; and an interconnecting portion electrically connected between said first and second short-circuit portions and between said first and second ground portions, and being formed with a generally U-shaped main groove that has a pair of opposite ends adjacent to said first and second antennas, respectively.

2. The antenna assembly as claimed in claim 1, wherein said main groove has a length substantially equal to ¼ to ¾ of a wavelength corresponding to a first frequency band, in which said first radiating portion and said second radiating portion resonate.

3. The antenna assembly as claimed in claim 2, wherein said main groove includes a pair of first groove segments disposed respectively at said opposite ends of said main groove and spaced apart from each other, and a second groove segment connected between said first groove segments and in spatial communication therewith.

4. The antenna assembly as claimed in claim 3, wherein said interconnecting portion is further formed with a supplementary groove having a pair of opposite ends adjacent to said first and second antennas, respectively, and a connecting groove connected between said supplementary groove and said second groove segment of said main groove and being in spatial communication therewith.

5. The antenna assembly as claimed in claim 4, wherein said supplementary groove has a length substantially equal to ¼ to ¾ of the wavelength corresponding to the first frequency band.

6. The antenna assembly as claimed in claim 5, wherein:

said supplementary groove is generally U-shaped and includes a pair of third groove segments disposed respectively at said opposite ends of said supplementary groove and spaced apart from each other, and a fourth groove segment connected between said third groove segments; and said connecting groove is connected between said second groove segment of said main groove and said fourth groove segment of said supplementary groove.

7. The antenna assembly as claimed in claim 6, wherein said connecting groove has two distal ends, one of which is connected to a midpoint of said second groove segment, and the other one of which is connected to a midpoint of said fourth groove segment.

8. The antenna assembly as claimed in claim 1, wherein:

said first radiating portion and said second radiating portion resonate in a first frequency band; and said first antenna further includes a first coupling portion that extends from said first ground portion along said first feed-in portion and that is spaced apart from and couples with said first feed-in portion so as to resonate with said first feed-in portion in a second frequency band.

9. The antenna assembly as claimed in claim 8, wherein said second antenna further includes a second coupling portion that extends from said second ground portion along said second feed-in portion and that is spaced apart from and couples with said second feed-in portion so as to resonate with said second feed-in portion in the second frequency band.

10. The antenna assembly as claimed in claim 9, wherein the first frequency band ranges between 2.4 to 2.5 GHz, and the second frequency band ranges between 5.15 to 5.85 GMHz.

11. A wireless communication device comprising:

a communication module for generating a first radio frequency (RF) signal and a second radio frequency (RF) signal;

a first transmission element electrically connected to said communication module for delivering the first RF signal;

a second transmission element electrically connected to said communication module for delivering the second RF signal; and an antenna assembly including a first antenna including a first ground portion, a first feed-in portion being spaced apart from said first ground portion and having a first feed-in end that is electrically connected to said first transmission element to be fed with the first RF signal, a first short-circuit portion electrically connected to said first ground portion and said first feed-in portion, and a first radiating portion electrically connected to said first feed-in portion and spaced apart from said first ground portion;

a second antenna including a second ground portion, a second feed-in portion being spaced apart from said second ground portion and having a second feed-in end that is electrically connected to said second transmission element to be fed with the second RF signal, a second short-circuit portion electrically connected to said second ground portion and said second feed-in portion, and a second radiating portion electrically connected to said second feed-in portion and spaced apart from said second ground portion; and an interconnecting portion electrically connected between said first and second short-circuit portions and between said first and second ground portions, and being formed with a generally U-shaped main groove that has a pair of opposite ends adjacent to said first and second antennas, respectively.

12. The wireless communication device as claimed in claim 11, wherein said main groove has a length substantially equal to ¼ to ¾ of a wavelength corresponding to a first frequency band, in which said first radiating portion and said second radiating portion resonate.

13. The wireless communication device as claimed in claim 12, wherein said main groove includes a pair of first groove segments disposed respectively at said opposite ends of said main groove and spaced apart from each other, and a second groove segment connected between said first groove segments and in spatial communication therewith.

14. The wireless communication device as claimed in claim 13, wherein said interconnecting portion is further formed with a supplementary groove having a pair of opposite ends adjacent to said first and second antennas, respectively, and a connecting groove connected between said supplementary groove and said second groove segment of said main groove and being in spatial communication therewith.

15. The wireless communication device as claimed in claim 14, wherein said supplementary groove has a length substantially equal to ¼ to ¾ of the wavelength corresponding to the first frequency band.

16. The wireless communication device as claimed in claim 15, wherein:

said supplementary groove is generally U-shaped and includes a pair of third groove segments disposed respectively at said opposite ends of said supplementary groove and spaced apart from each other, and a fourth groove segment connected between said third groove segments; and said connecting groove is connected between said second groove segment of said main groove and said fourth groove segment of said supplementary groove.

17. The wireless communication device as claimed in claim 16, wherein said connecting groove has two distal ends, one of which is connected to a midpoint of said second groove segment, and the other one of which is connected to a midpoint of said fourth groove segment.

18. The wireless communication device as claimed in claim 11, wherein:

said first radiating portion and said second radiating portion resonate in a first frequency band; and said first antenna further includes a first coupling portion that extends from said first ground portion along said first feed-in portion and that is spaced apart from and couples with said first feed-in portion so as to resonate with said first feed-in portion in a second frequency band.

19. The wireless communication device as claimed in claim 18, wherein said second antenna further includes a second coupling portion that extends from said second ground portion along said second feed-in portion and that is spaced apart from and couples with said second feed-in portion so as to resonate with said second feed-in portion in the second frequency band.

20. The wireless communication device as claimed in claim 19, wherein the first frequency band ranges between 2.4 to 2.5 GHz, and the second frequency band ranges between 5.15 to 5.85 GMHz.

* * * * *